US010014598B2

(12) United States Patent
Uezono

(10) Patent No.: US 10,014,598 B2
(45) Date of Patent: Jul. 3, 2018

(54) TERMINAL FITTING

(71) Applicant: Sumitomo Wiring Systems, Ltd., Yokkaichi, Mie (JP)

(72) Inventor: Katsuya Uezono, Mie (JP)

(73) Assignee: SUMITOMO WIRING SYSTEMS, LTD. (JP)

( * ) Notice: Subject to any disclaimer, the term of this patent is extended or adjusted under 35 U.S.C. 154(b) by 0 days.

(21) Appl. No.: 15/597,378

(22) Filed: May 17, 2017

(65) Prior Publication Data

US 2017/0358873 A1 Dec. 14, 2017

(30) Foreign Application Priority Data

Jun. 10, 2016 (JP) ..... 2016-116014

(51) Int. Cl.

| | |
|---|---|
| ***H01R 4/58*** | (2006.01) |
| ***H01R 4/26*** | (2006.01) |
| ***H01R 13/11*** | (2006.01) |
| *H01R 4/18* | (2006.01) |

(52) U.S. Cl.

CPC ..... *H01R 4/58* (2013.01); *H01R 4/26* (2013.01); *H01R 13/113* (2013.01); *H01R 4/185* (2013.01)

(58) Field of Classification Search

CPC ..... H01R 13/113; H01R 13/114

See application file for complete search history.

(56) References Cited

U.S. PATENT DOCUMENTS 7,156,704 B2 * 1/2007 Shimizu ..... H01R 13/113 439/852

FOREIGN PATENT DOCUMENTS

JP 2001-210418 8/2001

* cited by examiner

*Primary Examiner* — Ross Gushi

(74) *Attorney, Agent, or Firm* — Gerald E. Hespos; Michael J. Porco; Matthew T. Hespos

(57) ABSTRACT

A terminal fitting (F) includes a pressure receiving portion (20) formed by causing a part of a first top plate (13) constituting a rectangular tubular body (10) to project toward a resilient contact piece (18), a locking projection (15) flush with the first top plate (13) and projecting from an extending end edge (13E) of the top plate (13) extending in a front-rear direction and locked to a right side plate (12R), and a right side edge (22R) constituting an outer peripheral edge part of the pressure receiving portion (20) and arranged along the extending end edge (13E) of the first top plate (13). A spacing in a width direction between the extending end edge (13E) of the first top plate (13) and the right side edge (22R) is smallest in an area corresponding to the locking projection (15).

5 Claims, 8 Drawing Sheets

TERMINAL FITTING

BACKGROUND

1. Field of the Invention

The invention relates to a terminal fitting.

2. Description of the Related Art

Japanese Unexamined Patent Publication No. 2001-210418 discloses a female terminal fitting with a resilient contact piece in a rectangular tubular body. The body includes a base plate, side plates standing up from left and right sides of the base plate, a first top plate extending parallel to the base plate from one side plate and a second top plate extending along an outer surface of the first top plate from the other side plate. The resilient contact piece faces the first top plate. A tab of a mating terminal inserted into the body from the front is sandwiched resiliently between the resilient contact piece and the first top plate.

The first top plate is formed with a pressure receiving portion extending parallel to an inserting direction of the tab and projecting toward the resilient contact piece. The pressure receiving portion is formed by striking part of the first top plate using a press. In pressing, an extending end edge of the first top plate is held by the press. However, if a width of a held part is small, the extending end edge of the first top plate jumps up toward an outer surface (i.e. side opposite to the one toward which the pressure receiving portion is struck) and the first top plate is deformed improperly after the pressure receiving portion is struck and holding is released.

Improper deformation of the first top plate can be prevented by increasing the width of the part held by the press. However, widening the spacing between the extending end edge of the first top plate and the side edge of the pressure receiving portion narrows the width of the pressure receiving portion when there is a restriction on a width of the terminal fitting. The pressure receiving portion is brought into surface contact with the tab to restrict lateral inclination of the tab. Thus, narrowing the pressure receiving portion reduces the ability of the pressure receiving portion to perform its intended function.

Accordingly, the width of the first top plate may be increased to prevent improper deformation of the first top plate without reducing the function of the pressure receiving portion. However, widening the first top plate increases the width of the terminal fitting and requires a larger housing.

The invention was completed based on the above situation and aims to prevent improper deformation of a terminal fitting without enlarging the terminal fitting.

SUMMARY

The invention is directed to a terminal fitting with a rectangular tubular body that has a base plate, two side plates standing up from left and right sides of the base plate and a top plate extending from one side plate to face the base plate. A resilient contact piece is arranged in the body and is configured so that a tab of a mating terminal inserted into the body from the front is sandwiched resiliently between the top plate and the resilient contact piece. A pressure receiving portion is formed by causing a part of the top plate to project toward the resilient contact piece and can come into surface contact with the tab. A locking projection projects from an end of the top plate that extends in a front-rear direction and is flush with the top plate. The locking projection is locked to the other side plate. A side edge on an extending end of an outer peripheral part of the pressure receiving portion is arranged along the extending end of the top plate. A spacing in a width direction between the extending end edge of the top plate and the side edge on the extending end is smallest in an area corresponding to the locking projection. Thus, a large width of the pressure receiving portion can be ensured. This can prevent inclination of the tab without enlarging the terminal fitting. A relatively large spacing in the width direction between the side edge on the extending end side of the pressure receiving portion and the extending end edge of the top plate is ensured in an area not corresponding to the locking projection in the front-rear direction. Thus, improper deformation of the top plate can be prevented by holding this wide part with a press.

An area in front of the locking projection may be inclined with respect to an inserting direction of the tab into the body. Accordingly, the tab and the side edge on the extending end side slide while being held in point contact with each other when the tab is inserted in an inclined posture. Thus, sliding resistance is low.

The invention may be such that a width of the pressure receiving portion is smaller in an area in front of the locking projection than in the area corresponding to the locking projection. Accordingly, the area of the pressure receiving portion in front of the locking projection has a relatively small width and a small contact area with the tab. Thus, sliding resistance between the tab and the pressure receiving portion is reduced in the first half of the insertion process of the tab.

A contact portion may project from the resilient contact piece and may contact the tab in a properly inserted state. The contact portion may be arranged in front of the locking projection. According to this configuration, sliding resistance between the tab and the pressure receiving portion is low even if resistance suddenly increases when the tab contacts the contact portion. Thus, insertion resistance is reduced as a whole.

A width of the pressure receiving portion is smaller in an area behind the locking projection than in the area corresponding to the locking projection. According to this configuration, the area of the pressure receiving portion behind the locking projection has a relatively small width and a small contact area with the tab. Thus, sliding resistance between the tab and the pressure receiving portion is reduced in the second half of the insertion process of the tab.

DETAILED DESCRIPTION

Figure 1:
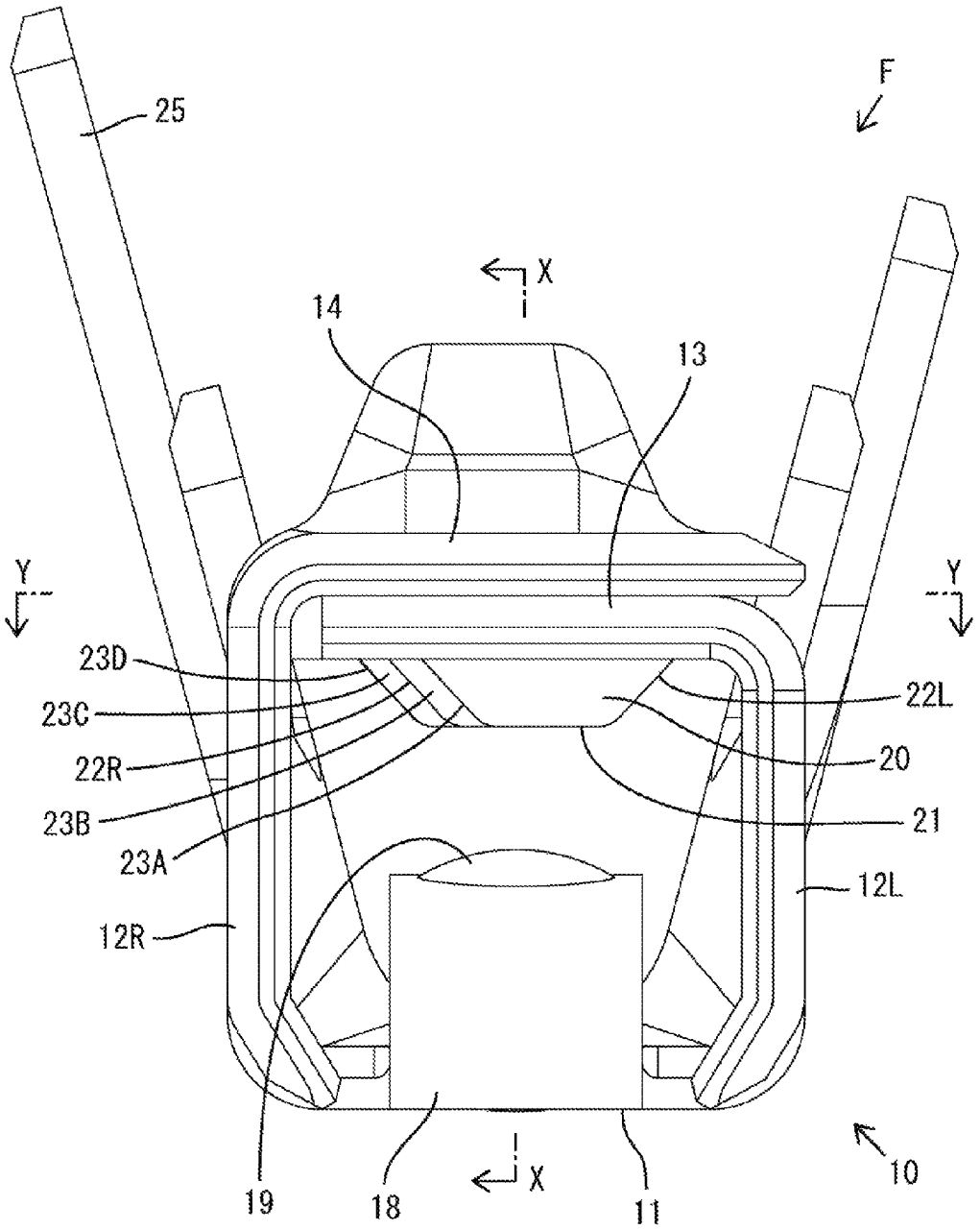
FIG. 1 is a front view of a terminal fitting of one embodiment.
Figure 2:
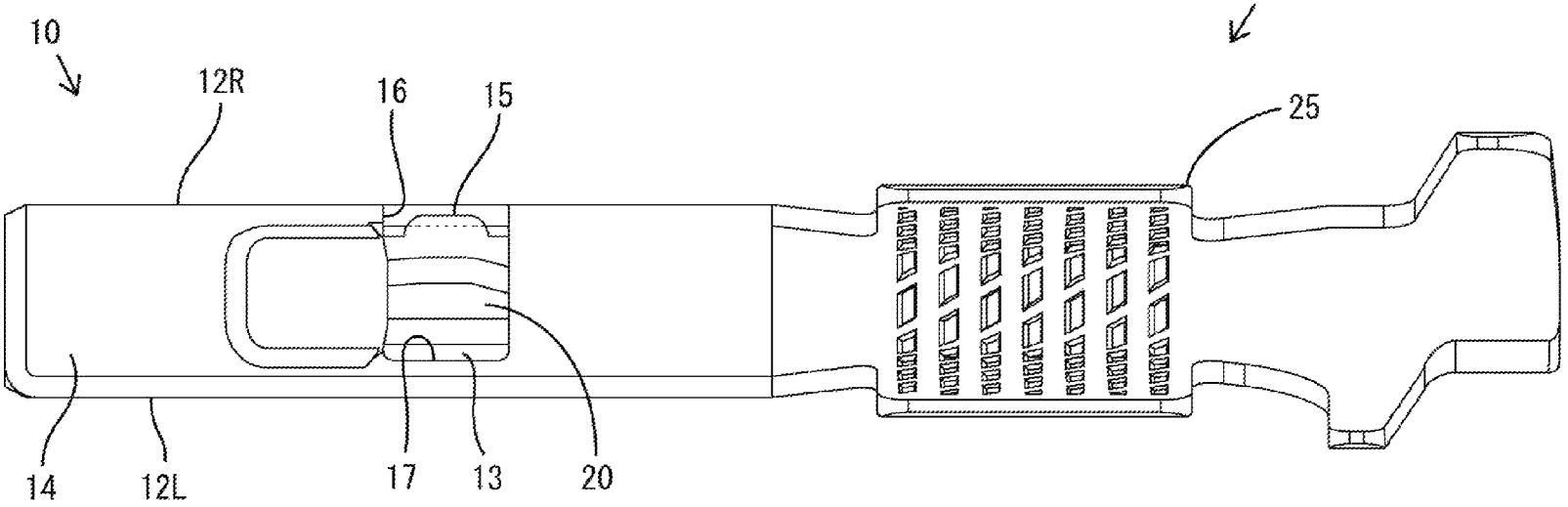
FIG. 2 is a plan view of the terminal fitting.
Figure 3:
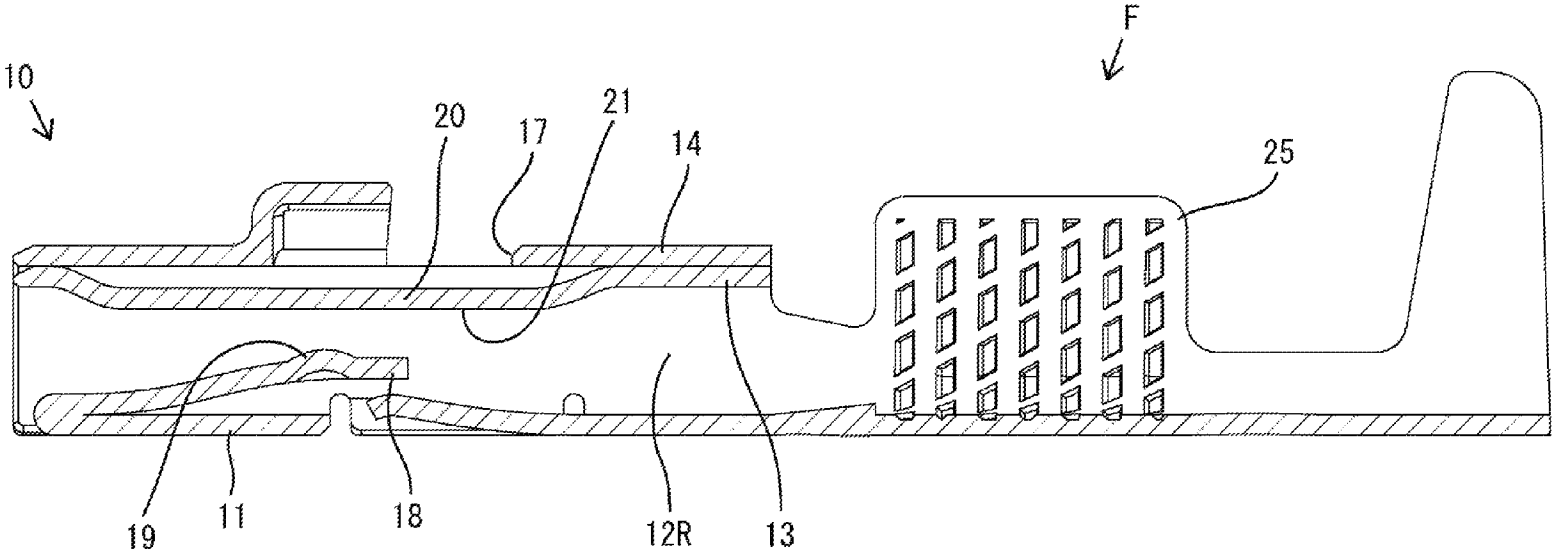
FIG. 3 is a section along X-X of FIG. 1.
Figure 4:
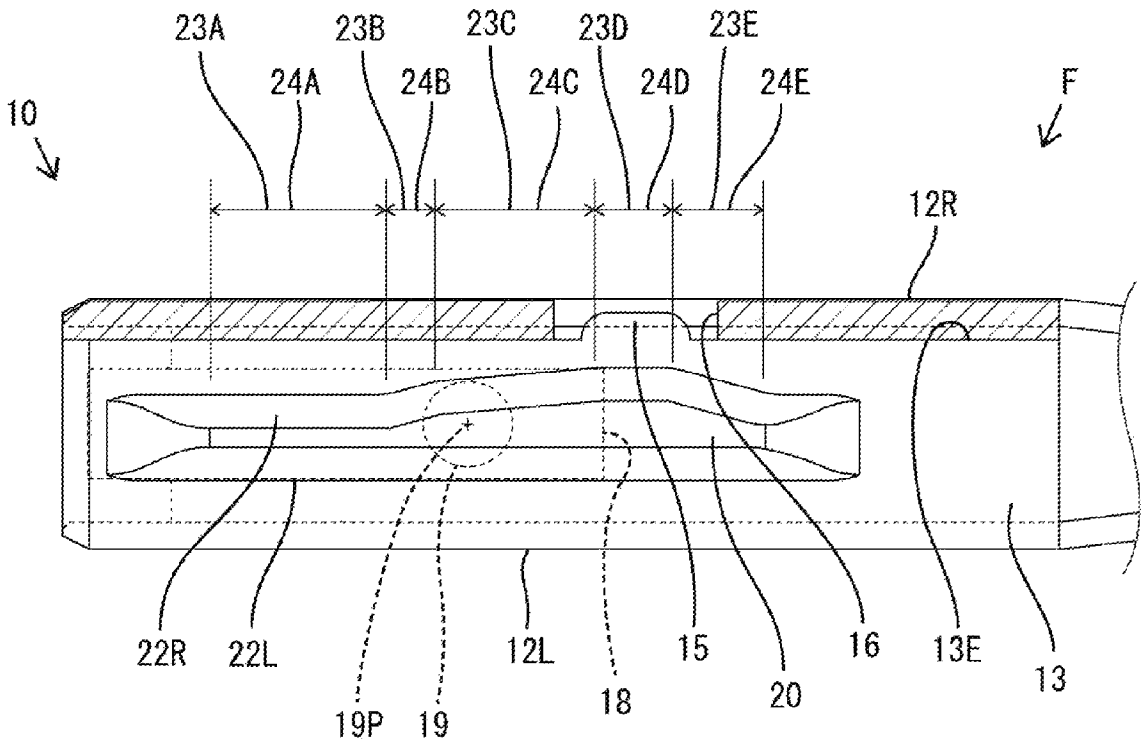
FIG. 4 is a partial enlarged section along Y-Y of FIG. 1.

One embodiment of the invention is described with reference to FIGS. 1 to 8. Note that, in the following description, a left side in FIGS. 2 to 4 is defined as a front concerning a front-rear direction. Upper and lower sides of FIGS. 1 and 3 are defined as upper and lower sides concerning a vertical direction. An upper side in FIGS. 2 and 4 is defined as a right side concerning a lateral direction. Thus, left and right sides are reversed in FIGS. 1, 7 and 8.

Figure 5:
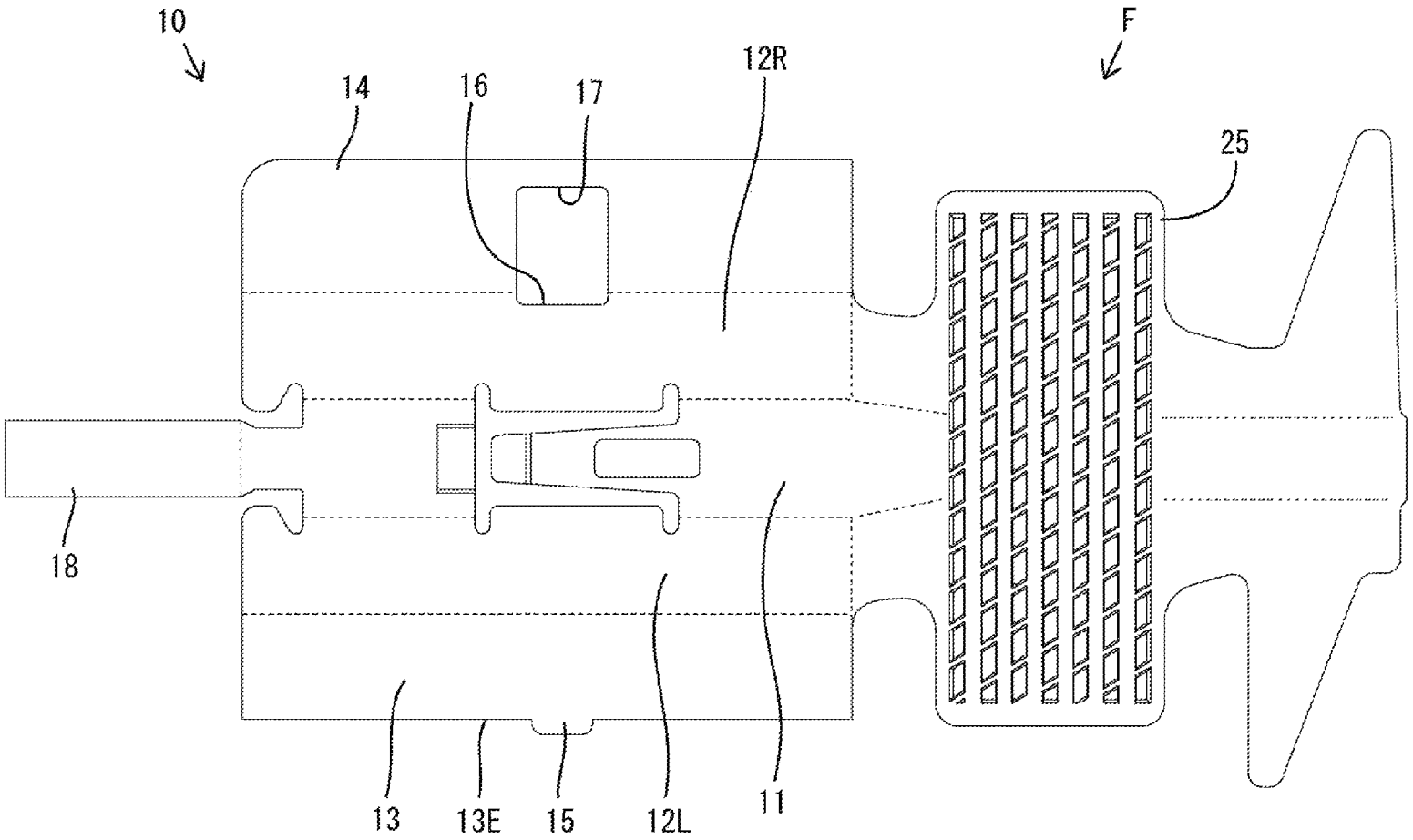
FIG. 5 is a development of the terminal fitting.
Figure 6:
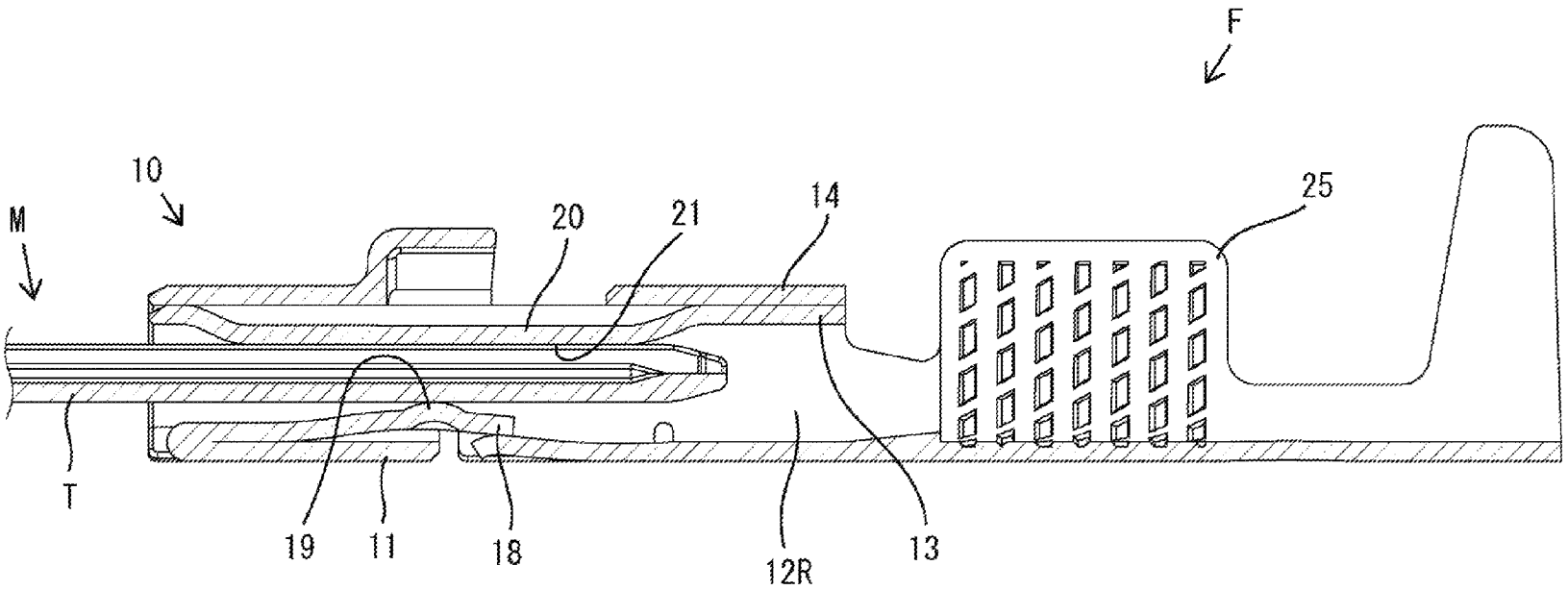
FIG. 6 is a side view in section in a state where the terminal fitting and a mating terminal are connected.
Figure 7:
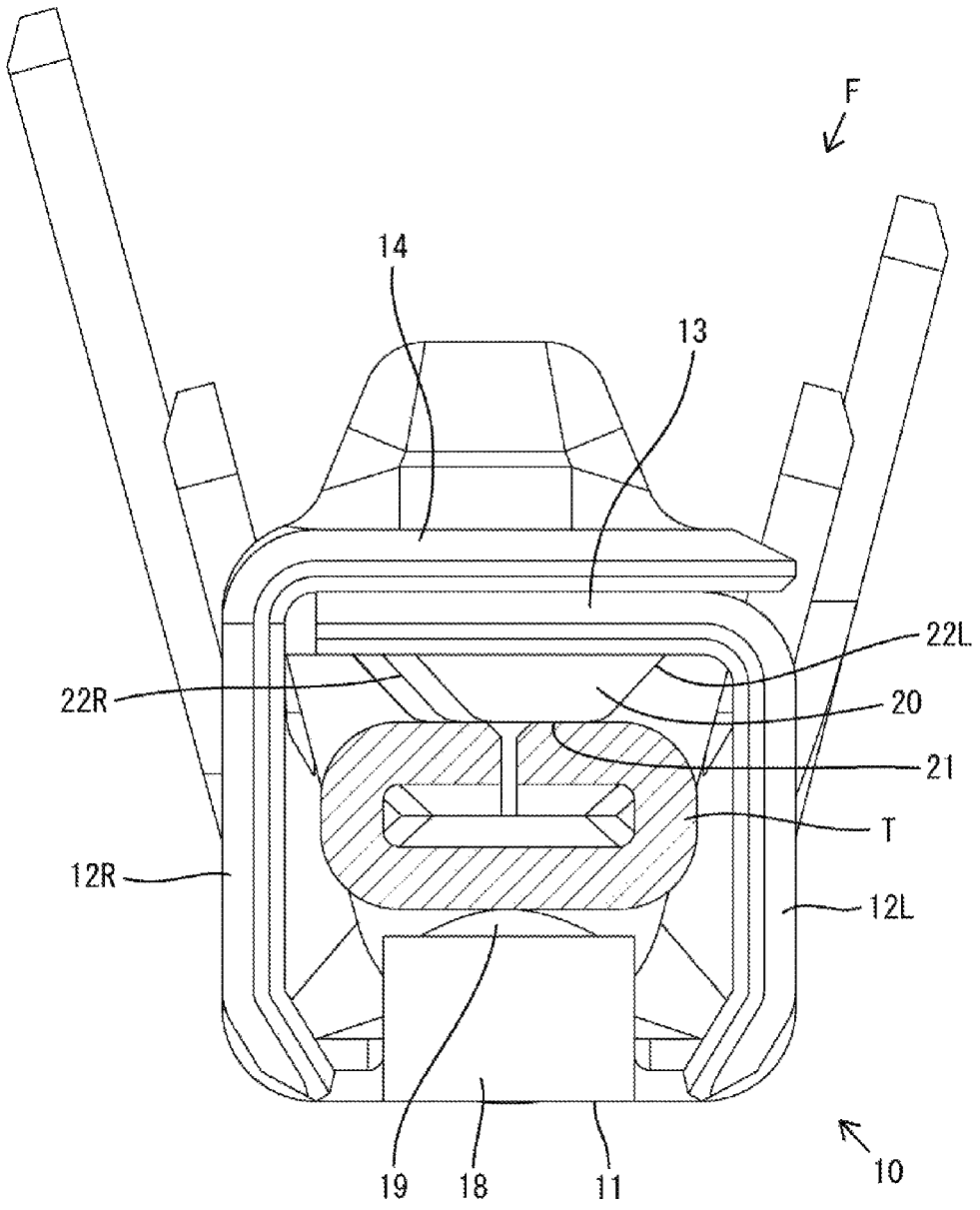
FIG. 7 is a front view partly in section showing a state where a tab is inserted in a proper posture in a body portion.

A terminal fitting F of this embodiment is a female terminal formed by bending and striking a metal plate having a predetermined development shape shown in FIG. 5, and is long and narrow in the front-rear direction. A front area of the terminal fitting F defines a rectangular tubular body 10. A tab T of a mating male terminal M is inserted into the body 10 from the front. A rear end area of the terminal fitting F defines a crimping portion 25 in the form of an open barrel. A front end part of a coated wire (not shown) is fixed conductively to the crimping portion.

The body 10 includes a base plate 11 that is long and narrow in the front-rear direction and that has a plate thickness direction aligned with the vertical direction. A left side plate 12L stands up at a substantially right angle from a left side of the base plate 11. A right side plate 12R stands up at a substantially right angle from a right side edge of the base plate 11. A first top plate 13 extends leftward from the upper end edge of the right side plate 12R to face the base plate 11. A second top plate 14 extends right from the upper end edge of the left side plate 12L to overlap the upper surface of the first top plate 13.

The first top plate 13 has an extending right side edge 13E that extends in the front-rear direction, and a locking projection 15 projects from the right side edge 13E so as to be flush with the first top plate 13. The locking projection 15 is arranged substantially in a central part of the first top plate 13 in the front-rear direction. A locking hole 16 is formed on the upper end edge of the right side plate 12R and the locking projection 15 is locked to the locking hole 16 while being held in contact with the locking hole 16 from above. The locking hole 16 communicates with an opening 17 formed in the second top plate 14.

A resilient contact piece 18 is folded rearward from the front end of the base plate 11 and into the body 10. The resilient contact piece 18 is inclined to approach the first top plate 13 toward a rear end. An upwardly convex contact 19 is formed at a position of the resilient contact piece 18 near an extending end (rear end part). The contact 19 is arranged in front of the locking projection 15 in the front-rear direction. Further, the resilient contact piece 18 and the contact 19 are arranged at a center position of the body 10 between the left and right side plates in a width direction.

The first top plate 13 is formed with a pressure receiving portion 20 configured to resiliently sandwich the tab T inserted into the body 10 from the front of the terminal fitting F between the contact 19 of the resilient contact piece 18 and the pressure receiving portion 20. The pressure receiving portion 20 is formed by causing a part of the first top plate 13 to project down toward the resilient contact piece 18, and is formed by striking using a press. When the tab T is inserted into the body 10, the resilient contact piece 18 is displaced resiliently down and a resilient restoring force of the resilient contact piece 18 is received by the pressure receiving portion 20 via the tab T.

A flat pressure receiving surface 21 is formed in an area of the lower surface (surface facing the resilient contact piece 18) of the pressure receiving portion 20, excluding an outer peripheral edge, and defines a flat surface parallel to an inserting direction of the tab T. With the tab T properly inserted in the body 10, the lower surface of the tab T is in point contact with a top 19P in the center of the contact 19 and the upper surface of the tab T is in surface contact with the pressure receiving surface 21. Thus, the pressure receiving portion 20 has a correcting function of restricting the posture inclination of the tab T in the lateral direction and the front-rear direction with respect to the first top plate 13.

As shown in FIG. 4, a formation range of the pressure receiving portion 20 in the front-rear direction is an area extending from a position near the front end of the first top plate 13 to a position behind the locking projection 15. That is, the pressure receiving portion 20 is formed continuously over an area extending from a front side to a rear side of the contact portion 19. A formation area of the pressure receiving portion 20 in the width direction is a range narrower than the entire width of the first top plate 13. Specifically, the entire left edge 22L of the pressure receiving portion 20 is closer to a center than a base end where the first top plate 13 is connected to the left side plate 12L. This left edge 22L of the pressure receiving portion 20 extends straight in parallel to the inserting direction of the tab T (front-rear direction) in the entire area thereof.

The entire area of a right side edge 22R (side edge on an extending side as claimed) of the pressure receiving portion 20 is closer to the center than (to the left of) an extending end edge 13E of the first top plate 13. The left edge 22L is linear in the front-rear direction over the entire length, whereas the right edge 22R is configured by connecting first to fifth side edge portions 23A to 23E divided in the inserting direction of the tab T one after another. Further, the pressure receiving portion 20 is divided into first to fifth pressure reception functioning portions 24A to 24E corresponding to the first to fifth side edge portions 23A to 23E.

The first side edge portion 23A is on the foremost side of the right side edge 22R is parallel to both the inserting direction of the tab T and the left edge 22L. Thus, a width of the first pressure reception functioning portion 24A is constant over the entire area from the front end to the rear end thereof. A spacing in the width direction between the first side edge portion 23A and the extending end edge 13E of the first top plate 13 is largest in the right side edge portion 22R. Thus, the width of the first pressure reception functioning portion 24A is smallest in the pressure receiving portion 20. The first pressure reception functioning portion 24A is displaced leftward with respect to a center of the body 10. The front end of the first side edge portion 23A is slightly behind the front end of the resilient contact piece 18 and the rear end thereof is located slightly in front of the contact portion 19.

The second side edge portion 23B extends rearward from the rear end of the first side edge portion 23A. The second side edge portion 23B is oblique to both the inserting direction of the tab T and the left edge 22L and is oriented such that a width thereof (pressure receiving surface 21) becomes gradually larger toward the rear. That is, a spacing in the width direction between the extending end edge 13E of the first top plate 13 and the second side edge portion 23B is narrowed gradually toward the rear. The second pressure reception functioning portion 24B is displaced leftward with respect to the center of the body 10. The rear end of the second side edge portion 23B is slightly behind the center of the contact portion 19. A length of the second side edge portion 23B in the front-rear direction is shorter than that of the first side edge portion 23A.

The third side edge portion 23C extends rearward from the rear end of the second side edge portion 23B. The third side edge portion 23C is oblique to both the inserting direction of the tab T and the left edge 22L and is oriented such that a width thereof (pressure receiving surface 21)

becomes gradually larger toward the rear. That is, a spacing in the width direction between the extending end edge 13E of the first top plate 13 and the third side edge portion 23C gradually narrows toward the rear. The third pressure reception functioning portion 24C is displaced leftward with respect to the center of the body 10.

An angle between the inserting direction of the tab T and the third side edge portion 23C is smaller than the angle between the inserting direction of the tab T and the second side edge portion 23B. The rear end of the third side edge constituent portion 23C is behind the contact portion 19 and aligns with a front end part of the locking projection 15. The third side edge portion 23C is longer in the front-rear direction than the second side edge portion 23B and substantially the same length as the first side edge portion 23A.

The fourth side edge portion 23D extends rearward from the rear end of the third side edge portion 23C. The fourth side edge portion 23D is substantially parallel to both the inserting direction of the tab T and the left side edge 22L. Thus, a width of the fourth pressure reception functioning portion 24D is constant over the entire area from the front to the rear thereof. A spacing in the width direction between the fourth side edge portion 23D and the extending end edge 13E of the first top plate 13 is smallest in the right side edge 22R. Thus, the width of the fourth pressure reception functioning portion 24D is largest in the pressure receiving portion 20. Further, the fourth pressure reception functioning portion 24D is in a widthwise center of the body 10.

The rear end of the fourth side edge portion 23D aligns with the front end of the locking projection 15. That is, the fourth pressure reception functioning portion 24D has a maximum width in the pressure receiving portion 20 and aligns with the locking projection 15 in the front-rear direction. Further, the fourth side edge portion 23D is shorter in the front-rear direction is than the first and third side edge portions 23A, 23C and slightly longer than that of the second side edge portion 23B.

The fifth side edge portion 23E extends rearward from the rear end of the fourth side edge portion 23D and is at the rearmost end of the right side edge 22R. The fifth side edge portion 23E is oblique to the inserting direction of both the tab T and the left edge 22L and is oriented so that a width thereof (pressure receiving surface 21) becomes gradually narrower toward the rear. That is, a spacing in the width direction between the extending end edge 13E of the first top plate 13 and the fifth side edge portion 23E gradually increases toward the rear. The fifth pressure reception portion 24E is displaced leftward with respect to the center of the body 10. The rear end of the fifth side edge portion 23E is rearward of the locking projection 15. The fifth side edge portion 23E is slightly shorter in the front-rear direction than the first and third side edge portions 23A, 23C and longer than the second and fourth side edge portions 23B, 23D.

The pressure receiving portion 20 is formed by partially striking the first top plate 13 using the press (not shown). In pressing, a narrow area of the first top plate portion 13 in the front-rear direction, which becomes the extending end edge 13E and the right side edge 22R, is held by being sandwiched in the plate thickness direction (vertical direction) by the press. If a width of the held part is extremely small at this time, a part of the first top plate 13 between the extending end edge 13E and the right side edge 22R jumps up toward an outer surface side (i.e. side opposite to the one toward which the pressure receiving portion 20 is struck) after the pressure receiving portion 20 is struck and holding is released. That is, the first top plate 13 is deformed improperly.

To prevent improper deformation of the first top plate 13, a large width of the part held by the press may be ensured by widening the spacing between the extending end edge 13E of the first top plate 13 and the right side edge 22R of the pressure receiving portion 20. However, if this configuration is adopted, the enlargement of the terminal fitting F (body 10) is unavoidable. Accordingly, in this embodiment, a sufficient width of the part held by the press is ensured by providing a large spacing between the right side edge 22R and the extending end edge 13E in a front side area (first, second and third side edge portions 23A, 23B and 23C) and a rear end part (fifth side edge portion 23E) of the right side edge 22R rather than making the entire right side edge 22R parallel to the extending end edge 13E of the first top plate 13. In this way, a part of the first top plate portion 13 extending along the extending end edge 13E is prevented from jumping up after the pressure receiving portion 20 is struck and holding is released.

The spacing between the right side edge 22R and the extending end edge 13E is narrowed in an area (fourth side edge portion 23D) of the right side edge 22R near the rear end in the front-rear direction. The locking projection 15 is flush with and projecting from the first top plate 13 is present at a position of this extending end edge 13E corresponding to the fourth side edge portion 23D. Thus, even if the spacing between the fourth side edge portion 23D and the extending end edge 13E is narrow, a sufficient holding area is ensured if the locking projection 15 is held by the press. Therefore, a part adjacent to the fourth side edge portion 23D can also is prevented from jumping up.

Further, by expanding spacings between the first, second, third and fifth side edge portions 23A, 23B, 23C and the 23E and the extending end edge 13E of the first top plate 13, the widths of the first, second, third and fifth pressure reception functioning portions 24A, 24B, 24C and 24E are narrowed. On the other hand, a sufficient width is ensured at the fourth pressure reception functioning portion 24D and the fourth pressure reception functioning portion 24D is bilaterally symmetrical with respect to a virtual axis line (not shown) passing through the top 19P (part to be held in point contact with the tab T) of the contact portion 19 and extending in the front-rear direction.

Accordingly, the pressure receiving portion 20 can sufficiently exhibit a desired function of preventing the posture inclination of the tab T in the lateral direction by bringing the tab T into surface contact with the pressure receiving surface 21 of the fourth pressure reception functioning portion 24D. Further, the top 19P of the contact portion 19 is located within a range of the pressure receiving surface 21 of the third pressure reception functioning portion 24C in the lateral direction. Thus, the pressure receiving portion 20 can sufficiently exhibit the desired function of preventing the posture inclination of the tab T in the lateral direction.

When the tab T is inserted into the body 10, the upper surface of the tab T slides in contact with the first pressure reception functioning portion 24A of the pressure receiving surface 21 in the initial stage of insertion. This first pressure reception functioning portion 24A has a smallest width in the pressure receiving portion 20. Thus, sliding resistance between the tab T and the pressure receiving portion 20 is reduced. In the process of bringing an inserting end part of the tab T into contact with the second pressure reception functioning portion 24B, sliding resistance between the tab T and the pressure receiving portion 20 gradually increases rather than suddenly increasing since the width of the second pressure reception functioning portion 24B becomes gradually larger toward the rear side.

Figure 8:
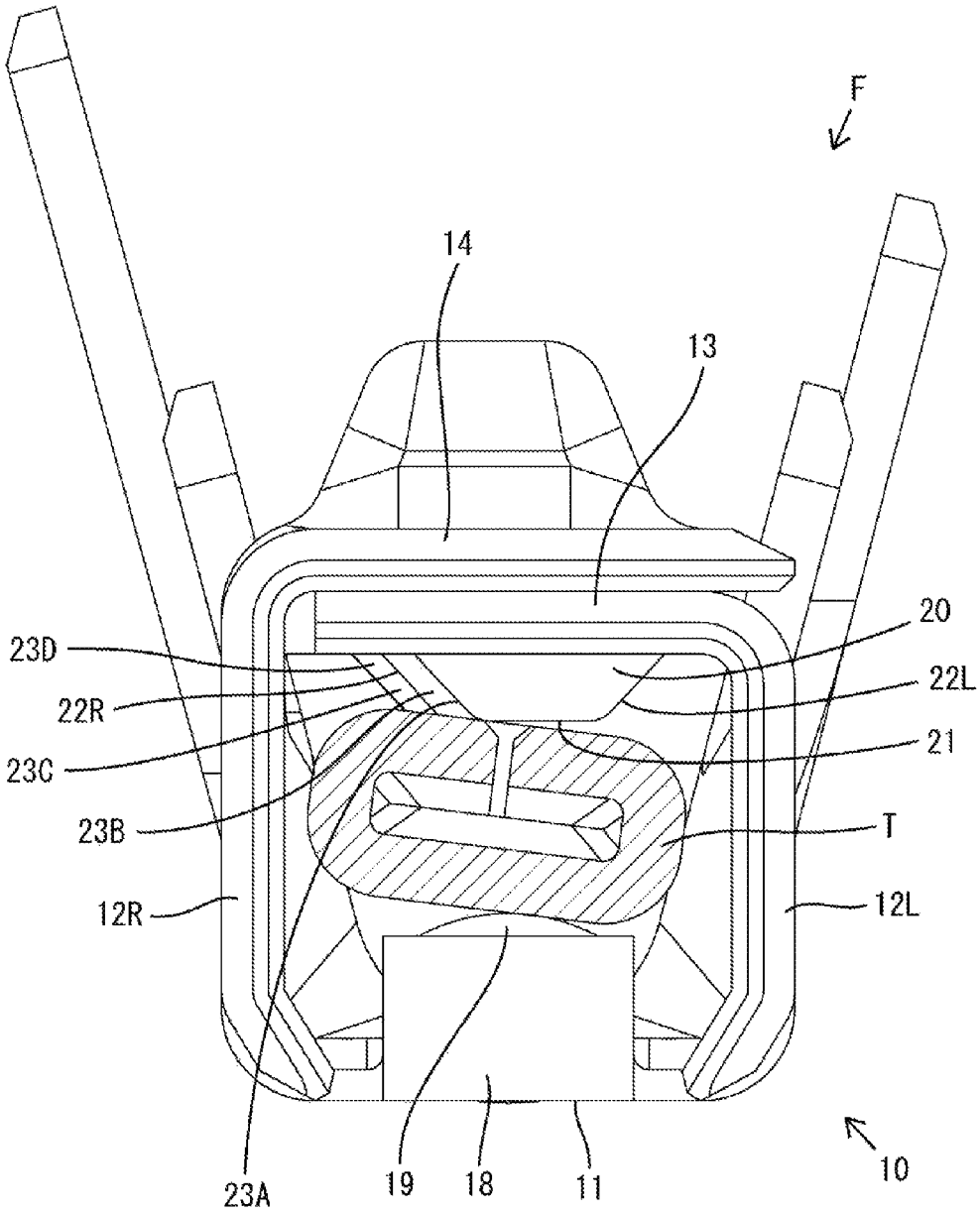
FIG. 8 is a front view partly in section showing a state where the tab is inserted in an inclined posture in the body portion.

The tab T may be inserted into the body 10 in an inclined posture to be separated from the pressure receiving surface 21, as shown in FIG. 8. In this situation, the upper surface of the tip part of the tab T slides while being held in line contact with the first side edge portion 23A. Thus, sliding resistance between the tab T and the pressure receiving portion 20 is reduced. If the tab T is inserted farther in this posture, the upper surface of the inserting end part of the tab T slides in contact with the second side edge portion 23B. However, the second side edge portion 23B is oblique to the inserting direction of the tab T, the tab T and the second side edge portion 23B slide while being held in point contact with each other. Thus, sliding resistance between the tab T and the pressure receiving portion 20 is reduced. The third side edge constituent portion 23C also is oblique to the inserting direction of the tab T. Hence, sliding resistance between the tab T and the pressure receiving portion 20 also is reduced when the tab T slides in contact with the third side edge portion 23C as when the tab T slides in contact with the second side edge portion 23B.

When the tab T is inserted further, the amount of resilient deflection of the resilient contact piece 18 increases. Thus, a force of the resilient contact piece 18 to push up the tab T also increases. Therefore, when the tab T is inserted to a proper position, the posture of the tab T is corrected and the upper surface of the tab T comes into surface contact with the pressure receiving surface 21 due to a large resilient restoring force of the resilient contact piece 18.

The terminal fitting F of this embodiment includes the rectangular tubular body 10 and the resilient contact piece 18 is in the body 10. The body 10 includes the base plate 11, the two side plates 12L, 12R standing up from both left and right sides of the base plate 11 and the first top plate 13 extending from the left side plate 12L to face the base plate 11. The resilient contact piece 18 resiliently sandwiches the tab T of the mating terminal M inserted into the body 10 between the first top plate 13 and the resilient contact piece 18.

The first top plate 13 is formed with the pressure receiving portion 20 formed by causing a part of the first top plate 13 to project toward the resilient contact piece 18 and capable of coming into surface contact with the tab T. Similarly, the first top plate 13 is formed with the locking projection 15 flush with the first top plate 13 and projecting from the extending end edge 13E of the first top plate 13 that extends in the front-rear direction. The locking projection 15 is locked to the right side plate 12R. The pressure receiving portion 20 includes the right side edge 22R constituting an outer peripheral edge of the pressure receiving portion 20 and arranged along the extending edge 13E of the first top plate 13. The spacing in the width direction between the extending end edge 13E of the first top plate portion 13 and the right side edge portion 22R is smallest at the fourth side edge portion 23D aligned with the locking projection 15.

The technical significance of this configuration is as follows. The spacing in the width direction between the extending end edge 13E of the first top plate 13 and the right side edge 22R is smallest at the fourth side edge portion 23D corresponding to the locking projection 15 in the front-rear direction (direction parallel to the inserting direction of the tab T into the body 10). Thus, a large width of the fourth pressure reception functioning portion 24D in the pressure receiving portion 20 can be ensured, thereby preventing lateral inclination of the tab T without enlarging the terminal fitting F.

In the areas (first, second, third and fifth side edge portions 23A, 23B, 23C and 23E) not corresponding to the locking projection 15 in the front-rear direction, a relatively large spacing is ensured in the width direction between the right side edge 22R of the pressure receiving portion 20 and the extending end edge 13E of the top plate 13. Thus, improper deformation (jump-up) of the first top plate 13 associated with striking and forming the pressure receiving portion 20 can be prevented by holding these wide parts with the press.

At least a part (second and third side edge constituent portions 23B, 23C) of an area of the right side edge 22R in front of the locking projection 15 is inclined with respect to the inserting direction of the tab T into the body 10. Accordingly, since the tab T and the right side edge 22R slide while being held in point contact with each other when the tab T is inserted in an inclined posture, sliding resistance is low.

The width of the pressure receiving portion 20 is smaller at the first, second and third pressure reception functioning portions 24A, 24B and 24C, which is an area in front of the locking projection 15, than at the fourth pressure reception functioning portion 24D, which is an area corresponding to the locking projection 15. According to this configuration, the first, second and third pressure reception functioning portions 24A, 24B and 24C have a relatively narrow width and a small contact area with the tab T. Thus, sliding resistance between the tab T and the pressure receiving portion 20 is reduced in the first half of the insertion process of the tab T.

The resilient contact piece 18 has the contact portion 19 projecting to contact the tab T in a properly inserted state, and this contact portion 19 is arranged in front of the locking projection 15. Accordingly, even if resistance suddenly increases when the tab T contacts the contact portion 19, insertion resistance is reduced as a whole since sliding resistance between the tab T and the pressure receiving portion 20 is low.

The width of the pressure receiving portion 20 is smaller at the fifth pressure reception functioning portion 24E, which is an area behind the locking projection 15, than at the fourth pressure reception functioning portion 24D corresponding to the locking projection 15. According to this configuration, since the fifth pressure reception functioning portion 24E of the pressure receiving portion 20 behind the locking projection 15 has a relatively small width and a small contact area with the tab T, sliding resistance between the tab T and the pressure receiving portion 20 is reduced in the second half of the insertion process of the tab T.

The invention is not limited to the above described and illustrated embodiment. For example, the following embodiments are also included in the scope of the invention.

Although a part of the area in front of the locking projection out of the side edge portion on the extending end side is inclined with respect to the inserting direction of the tab in the above embodiment, the entire area in front of the locking projection on the extending end side may be inclined with respect to the inserting direction of the tab or may be parallel to the inserting direction of the tab.

The contact portion of the resilient contact piece is arranged in front of the locking projection in the above embodiment, but the contact portion may be arranged at the same position as or behind the locking projection in the front-rear direction.

The width of the pressure receiving portion is largest in the area corresponding to the locking projection in the above embodiment. However, the width of the pressure receiving portion may be substantially constant over the entire length from the front end to the rear end.

The width of the pressure receiving portion is smaller in the area in front of the locking projection than in the area corresponding to the locking projection in the above embodiment. However, the width of the area corresponding to the locking projection and that of the area in front of the locking projection may be equal.

The width of the pressure receiving portion is smaller in the area behind the locking projection than in the area corresponding to the locking projection in the above embodiment. However, the width of the area corresponding to the locking projection and that of the area behind the locking projection may be equal.

The area parallel to the inserting direction of the tab is partially formed in front of the locking projection on the extending end side in the above embodiment. However, the entire area in front of the locking projection on the extending end side may be parallel to the inserting direction of the tab or may be inclined with respect to the inserting direction of the tab.

The side edge opposite to the side edge on the extending end side out of the outer peripheral edge of the pressure receiving portion is parallel to the inserting direction of the tab in the above embodiment. However, the side edge opposite to the side edge on the extending end side out of the outer peripheral edge of the pressure receiving portion may be entirely or partially inclined with respect to the inserting direction of the tab.

Although the second top plate is overlapped on the outer surface of the first top plate formed with the pressure receiving portion in the above embodiment. However, another top plate may not be overlapped on the top plate portion formed with the pressure receiving portion.

LIST OF REFERENCE SIGNS

F . . . terminal fitting
M . . . mating terminal
T . . . tab
10 . . . body
11 . . . base plate
12L . . . left side plate
12R . . . right side plate
13 . . . first top plate
13E . . . extending end edge of first top plate
15 . . . locking projection
18 . . . resilient contact piece
19 . . . contact portion
20 . . . pressure receiving portion
22R . . . right side edge

What is claimed is:

1. A terminal fitting, comprising:

a rectangular tubular body including a base plate, left and right side plates spaced apart in a width direction of the terminal fitting and standing up from left and right sides of the base plate and a top plate extending from the left side plate to face the base plate;

a resilient contact piece arranged in the body and configured to resiliently sandwich a tab of a mating terminal inserted into the body between the top plate and the resilient contact piece;

a locking projection flush with the top plate and projecting from an extending end edge of the top plate that extends in a front-rear direction, the locking projection being locked to the second side plate; and a pressure receiving portion formed by causing a part of the top plate to project toward the resilient contact piece and configured for coming into surface contact with the tab, the pressure receiving portion having opposite side edges spaced apart in the width direction, a spacing between the side edges of the pressure receiving portion defining a width for the pressure receiving portion, the width of the pressure receiving portion being maximum at locations aligned with the locking projection in the front-rear direction and the width of the pressure receiving portion at positions forward and rearward of the locking projection in the front-rear direction being less than the maximum width.

2. The terminal fitting of claim 1, wherein the side edges of the pressure receiving portion include a first side edge in proximity to the first side plate and a second side edge in proximity to the second side plate, an area of the second side edge being at least partially inclined with respect to an inserting direction of the tab into the body.

3. The terminal fitting of claim 2, wherein the second side edge of the pressure receiving portion is inclined with respect to an inserting direction of the tab into the body in areas of the pressure receiving portion both forward and rearward of the locking projection with respect to the front-rear direction.

4. The terminal fitting of claim 3, wherein:

the resilient contact piece is formed with a contact portion projecting to contact the tab in a properly inserted state; and the contact portion is arranged in front of the locking projection.

5. The terminal fitting of claim 3, wherein the first side edge of the pressure receiving portion is substantially parallel to the inserting direction of the tab into the body.

* * * * *